United States Patent [19]

Sumner

[11] 4,068,422

[45] Jan. 17, 1978

[54] ROOFING FOR DOMICAL SHELL STRUCTURE

[76] Inventor: John S. Sumner, 728 N. Sawtelle, Tucson, Ariz. 85716

[21] Appl. No.: 663,191

[22] Filed: Mar. 2, 1976

Related U.S. Application Data

[63] Continuation-in-part of Ser. No. 544,766, Jan. 28, 1975, abandoned.

[51] Int. Cl.[2] ..... E04B 1/32

[52] U.S. Cl. ..... 52/80; 52/82; 52/747

[58] Field of Search ..... 52/80, 81, 82, 86, DIG. 10, 52/747

[56] References Cited

U.S. PATENT DOCUMENTS

| | | | |
|---|---|---|---|
| 2,151,234 | 3/1939 | Rutten | 52/81 |
| 2,736,072 | 2/1956 | Woods | 52/81 |
| 2,802,132 | 4/1974 | Sumner | 52/80 |
| 2,905,113 | 9/1959 | Fuller | 52/81 |
| 2,978,074 | 4/1961 | Schmidt | 52/80 |
| 3,812,632 | 5/1974 | Robertson | 52/81 |
| 3,894,367 | 7/1975 | Yacoboni | 52/80 |
| 3,950,901 | 4/1976 | Sumner | 52/80 |

FOREIGN PATENT DOCUMENTS

| | | | |
|---|---|---|---|
| 230,326 | 4/1959 | Australia | 52/80 |
| 1,572,266 | 3/1968 | France | 52/80 |

OTHER PUBLICATIONS

Dome Book II © 1971, p. 110.

*Primary Examiner*—Price C. Faw, Jr.
*Assistant Examiner*—Henry Raduazo
*Attorney, Agent, or Firm*—Warren F. B. Lindsley

[57] ABSTRACT

This disclosure describes an improved concept for using flat sheathing materials to construct the curved roof of a domical structure with the underlying dome frame and the shape of the roof panels designed to permit originally flat sheathing material to be curved in different directions. Thus, a single flat sheet of sheathing material may contain several different curved surfaces, improving the appearance and the shell effect of the roof and increasing the strength and economic efficiency of the domical structure.

9 Claims, 24 Drawing Figures

ROOFING FOR DOMICAL SHELL STRUCTURE

This application is a continuation-in-part of U.S. Pat. application Ser. No. 544,766, filed 1/28/75, now abandoned.

BACKGROUND OF THE INVENTION

This invention relates to the construction of domical structures and more particularly to a simple, integral assembly of a plurality of roof surfaces formed from originally flat sheathing materials to form the curved domical roof configuration. In order to accomplish this, the arch framework of the dome must provide support for the edges of the curved roof panels. It may be convenient at times to use straight supportive struts designed to underlie the roof panels especially along bend zones where an originally flat panel changes curvature from a curve in one direction to a flat portion or a curve in another direction.

The shell action of the curved sheathing surface lends additional strength to the overall domical structure, allowing the underlying arches to be lighter in weight than supportive members for flat surfaces. The greater structural strength of the disclosed shell configuration permits it to especially along bend zones where an originally flat panel changes curvature from a curve in one direction to a flat portion or a curve in another direction.

The shell action of the curved sheathing surface leads additional strength to the overall domical structure, allowing the underlying arches to be lighter in weight than supportive members for flat surfaces. The greater structural strength of the disclosed shell configuration permits it to be used for clear span construction without the need for bearing walls, although conventional vertical walls can be readily used with the disclosed shell structure, if so desired.

FIELD OF THE INVENTION

This invention uses the principles of spherical trigonometry and differential geometry to solve the problem inherent in the proper design and layout for domical structures.

Concepts are particularly directed toward the constructional features of domical structures wherein the frame of the dome is comprised of interconnected great circle arches. The originally flat roof panels are designed to exactly cover openings between arches. Straight struts may cross the curved triangular opening between arches with these struts optimally positioned to lie along the line of changing radius of curvature (bend zones) of the sheathing panels.

DESCRIPTION OF THE PRIOR ART

There have been many previous attempts at solving the problem of efficiently covering a dome with an originally flat surface. French Pat. No. 1,562,266 portrays a flat topped, three legged structure using an originally flat surface, but the structure is not really domical in shape using definable great circle arches. U.S. Pat. No. 3,812,632 discloses a domical structure with the edge arches specified as being arces of small circles and the surfacing material being reinforced with curved arches rather than with straight struts underlying bend zones. U.S. Pat. No. 2,978,074 uses curved geodesic struts and spherical isosceles triangles but there is no teaching about the more general aspects of spherical triangle covering problems including the method for the spherical scalene triangle, and there is no provision for a raised shell edge under which the structure could be entered.

SUMMARY OF THE INVENTION

In accordance with the innovations claimed, an improved method of designing and sheathing a domical structure is disclosed. The claimed domical frame configuration and sheathing panel layout provides a strong, low cost, easy to erect and efficient domical structure for use in domestic, commercial and military functions.

This invention employs a superior method of designing domical structures, taking advantage of triangular truss type construction techniques which allows the use of simple, strong, pinned joints between arches and beams. The angles between arches and beams are laid out to provide an interconnected triangular pattern with a straight cross beam (when used) forming the base of corner isosceles triangles as illustrated in the drawings. The straight cross beam acts as a bend zone along which the initially flat roof panel can smoothly change its radius of curvature and yet be fully supported and retain the strength that is inherent in curved panel sheathing materials. The bend zone itself strengthens the panel sheathing to the extent that the bend zone acts similar to a straight cross beam.

It is, therefore, one of the principal objects of this invention to provide the framing configuration for a domical structure so as to allow flat sheathing material to be used on the curved surface of the dome.

Another object of this invention is to make the framing configuration of the dome such that flat sheathing material can be laid so that it will curve in more than one direction enhancing the shell properties of the domical structure.

Another object of this invention is to provide design criteria for flat surface panels so that they will fit over curved openings of a framed structural dome.

Another object of this invention is to show how to lay out an edge pattern on flat surface panels so that the panel will fit over curved openings of the dome and will be curved in different directions, enhancing the shell characteristics of the dome.

Another object of this invention is to create a domical structure which enbraces all of the advantages of great strength, minimum amounts of materials, low cost, and efficiency, yet is simple to construct and erect.

Another object of this invention is to provide a simple and effective means for improving the shell characteristic of domical structures.

Another object of this invention is to provide a means for sectionalizing the arches, beams and panels employed in the structure so as to facilitate shipping and handling and to permit the easy erection of the structure by relatively unskilled persons.

These and other objects and advantages of this invention will become more apparent as the description is given and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings of which.

DESCRIPTION OF THE PREFERRED EMBODIMENT

Domical Structure

Figure 1:
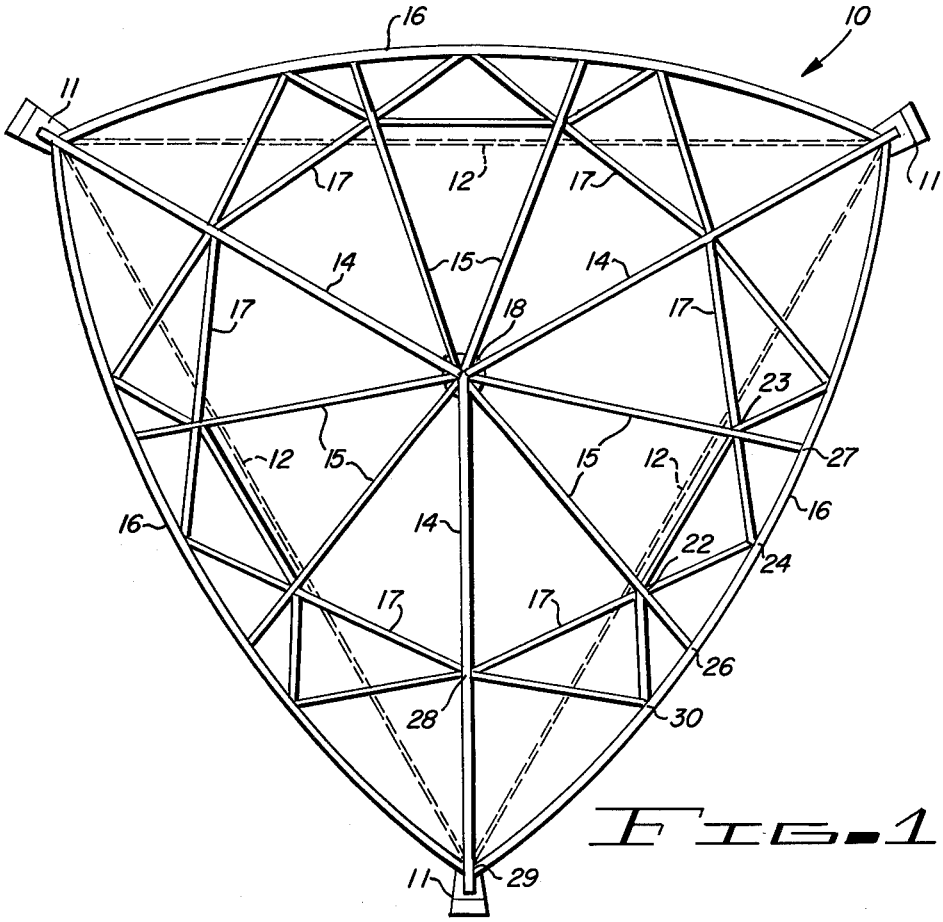
FIG. 1 is a top plan view of an improved domical structure.
Figure 2:
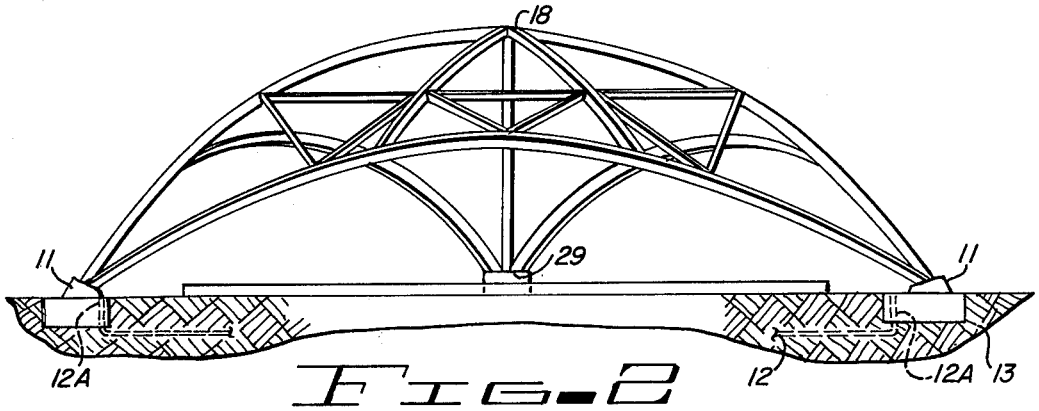
FIG. 2 is a side view of FIG. 1.
Figure 3:
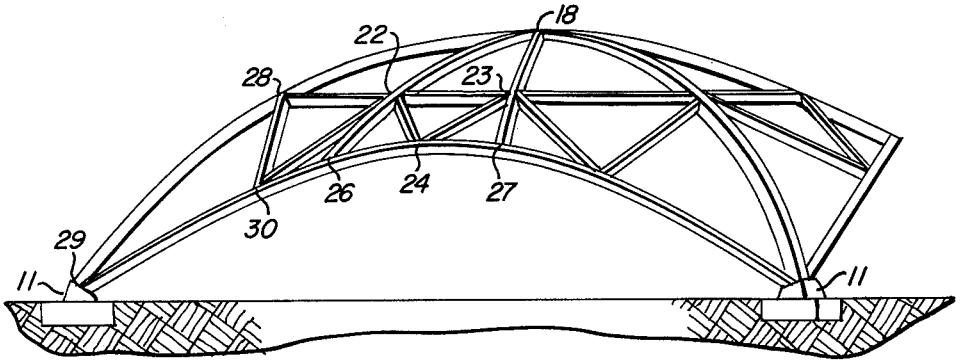
FIG. 3 is a second side view of FIG. 1.

Referring more particularly to the drawings by characters of reference, FIGS. 1–3 disclose a framework for a domical structure 10 having a base or mounting pad 11 for each of the corners of the domical structures, the bases 11 being prevented from spreading apart by interconnecting underground tensional bars 12 running between adjacent bases 11.

Base 11 is typically a reinforced concrete pad extending well above the surface of the ground 13 and extending in colder climates below the front line.

The framework of the domical structure 10, as shown clearly in FIGS. 1–3, comprises primary arches 14, secondary arches 15, edge arches 16 and straight cross beams 17. In the embodiment shown in the drawings, there are three primary arches 14 and six secondary arches 15, the primary and secondary arches being arranged about the partial spherical contour of the domical structure 10 as great circles converging at the top center 18 of domical structure 10 in a manner similar to the arrangement of the longitudinal lines drawn on a globe of the earth.

The three primary arches are equally spaced from each other approximately 120° apart with two secondary arches lying between adjacent primary arches, again uniformly spaced so that between adjacent arches, priimary or secondary, there is an angular displacement of about 40° . The three approximately equally spaced primary arches rest at their lower ends on the three bases 11 while the secondary arches terminate well above the ground where they intersect the edge arch.

The edge arch also lies in the spherical surface of domical structure 10 and it extends between two adjacent bases 11 and rises to a height at its center more than half the height of the center 18 above the support of structure 10. Two edge arches thus converge with one primary arch at each of the three corners where the primary and edge arches are secured to bases 11 by means of special support brackets (not shown).

The cross beams 17 are arranged between adjacent primary and secondary arches completing a triangular truss pattern.

The strength of the domical structure 10 is inherent in its spherical contour by virtue of which the primary and edge arches are in compression, the total weight of the structure thus having the effect of forcing most of the joints or points of intersection between these arches into closer contact with each other. The secondary arches also have a bending movement imposedon them. Thus, they must resist a shearing force.

While these compressional forces would tend to drive the bases 11 outwardly, such undesired displacement is effectively controlled and prevented by the provision of the tensional rods 12. The subsurface tensional rods 12 can be ordinary bolted steel reinforcing bars with or without a turned up hook 12A at each end which is cast into the concrete base 11. The three rods 12 thus lie in the form of an equilateral triangle holding the three bases 11 securely at the corners of the triangle, the tension in the rods 12 thus counteracting the total outwardly component of compression exerted through the arches by the weight of the structure 10.

Although the embodiment shown in the drawing indicates a structure 10 having only three corners 29 supported by three bases 11, similar structures having more than three corners are contemplated and such similar structures fall within the spirit and scope of this invention.

Roof

The roof of this domical structure can use sheathing of tongue and groove boards, plywood, or composition boards with the usual covering of insulation, tar paper, shingles, etc. This sheathing material is initially flat before application, but becomes curved with the contour of the dome so that the sheathing acts like a domical shell over the framework of the structure.

An alternate roofing approach might use woven glass fibers, metal mesh, or a similar flexible base material which is laid directly over the arches, stretched taut and secured in place. A semi-liquid cement, capable of hardening, is then applied to the woven material. In this alternate roof construction, the draped roof material is in tension, thus it is possible to eliminate the straight cross beams thereby realizing an additional significant reduction in cost.

The sheathing may be preformed of individual sheets glued or fastened into individual panels for ease and speed of erection with fastening strips used if necessary to aid in securely fastening the panels together and to the framework of the domical structure.

In accordance with the invention claimed, a new and improved roofing structure is provided which will utilize a plurality of two or more kinds of curved triangular roof panels. Although four, five and six cornered domical structures can be built using these concepts, for simplicity, an equilateral three-cornered domical structure is shown and described.

Again, for the sake of simplicity in the designing of a dome formed from curved roof panels, a point of symmetry on the spherical triangle is chosen so that there is a cyclical repetition of pattern about this point. This planning method reduces the work in layout and actual construction of the building by making parts interchangeable with a minimum number of basic dimensions. The axis of highest symmetry of the equilateral spherical triangle is through the center of the figure, perpendicular to the spherical surface and the point of symmetry is the intersection of the axis with the surface. Extending from the point of symmetry, spherical equilateral, isosceles, or scalene triangles can be formed from an originally flat panel.

Another design consideration for a spherical triangular building is the availble entry height and side wall height of the structure. It is important to have a suitable vertical entry height when designing a small building since this dimension limits the minimum size of the structure. Buildings below a certain size are not feasible if they cannot be comfortably entered by a full size person. The optimum sized triangular shaped domical structure is readily divided into spherical triangles. Such a structure is shown by the curved arches of FIGS. 1, 2 and 3.

Curved Surfaces

Figure 10:
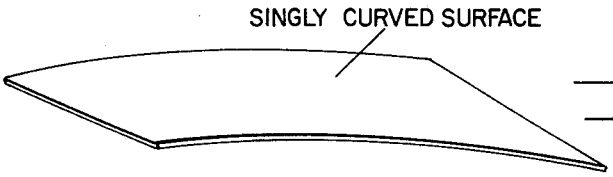
FIG. 10 is an illustration of a singly curved surface.
Figure 11:
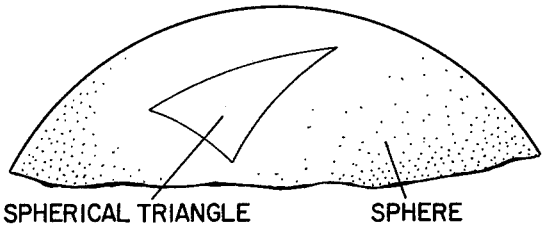
FIG. 11 is an illustration of a spherical triangular opening in a spherical surface.

In accordance with the invention claimed, the problem of conforming a singly curved surface as shown in FIG. 10 to the edges of a spherical triangle as shown in FIG. 11 has been solved. In disclosing the claimed invention, the following definitions should be kept in mind:

A spherical triangles is one whose sides are formed of arcs of great circles. A great circle of a sphere is formed by the intersection of a plane through the sphere's center. A small circle is any other plane intersection with the sphere.

A singly curved surface is a surface that may have originally been flat. The curvature of a flat surface with respect to a point on the surface is zero in both X, Y directions; that is, the radii of curvature are infinite since:

$$\text{curvature} = 1/(\text{radius of curvature}).$$

Figure 12:
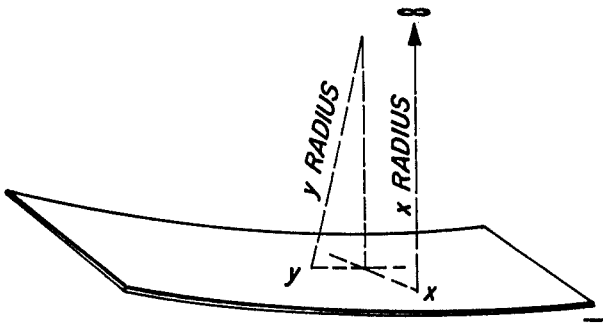
FIG. 12 is a further illustration of a singly curved surface.
Figure 9:
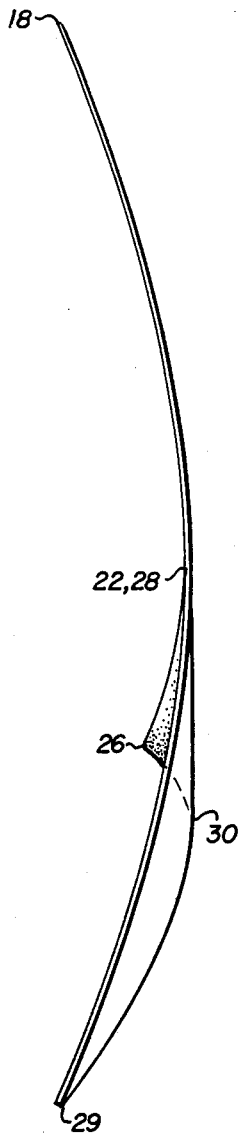
FIG. 9 is a side view of the corner roof panel shown in FIG. 7.

A singly curved surface, viewed at a point on the surface, has zero curvature (infinite radius of curvature) in one direction and some finite curvature value in the direction of right angles as shown in FIG. 12.

Figure 13:
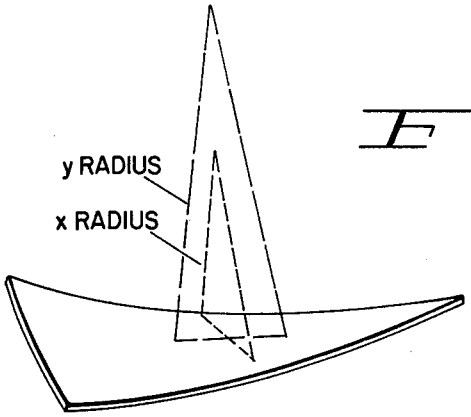
FIG. 13 is an illustration of a doubly curved surface.

A doubly curved surface, viewed at a point on the surface has a finite curvature value in both directions as shown in FIG. 13. A spherical surface has equal curvatures, both of the same sign, in two directions. An originally flat surface cannot be transformed into a doubly curved surface by simply bending, using the concepts of Euclidean geometry.

Figure 14:
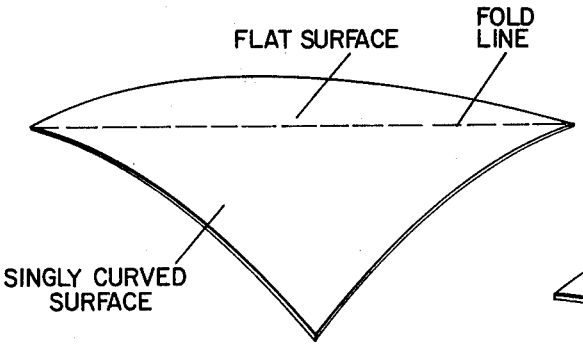
FIG. 14 is an illustration of a spherical triangle covered by a folded, singly curved surface.

It should be noted that all spherical triangles (equilateral, isosceles, and scalene) can be covered with a singly curved surface. But the covering technique must first be specified, because there are different methods of covering, some of which are not structurally acceptable because the originally flat surface may have to be folded to accomplish the covering. For example, a spherical triangle may be covered with a flat surface extending completely across two sides and the included angle and the third edge would be covered by the great circle plane extending to the first covering surface, intersecting along a straight fold line as shown in FIG. 14. This covering method would accomplish the basic objective, but this type of close folding would be structurally unacceptble.

Joints in the Shell

Any joints between standard sized panel segments of the dome's shell surface must be as strongly bonded and as rigid as the shell itself or the joint becomes a zone of weakness and possible eventual buckling. Of course, the major joints are between the spherical triangle sections along the length of the arches where adjoining curved surface sectors abut. Other joints, internal to a curved triangular sector may be made between standard sized sheets of the originally flat shell surface material, such as plywood or sheet metal. Here it is advisable to use a strongly fastened, nailed, riveted, or bonded joint, perhaps overlain and fastened to an underlying strut for additional structural strength.

Joints in the shell surface can be made most easily over the straight bend zones or over straight struts, parallel to the bend zone, that may be placed at intervals for additional skeletal strength, but joints can also be made on curved parts of the originally flat surface. For a maximum shell strength between sheets adjacent to a joint, the joint line should lie on the originally flat surface, which is common to the two surfaces being joined.

Layout of the Shell Surface

In order to obtain a maximum benefit from the strength of a domical shell surfaace, it is first necessary to plan and lay out the perimeter of the dome. The perimeter must sustain stress concentrations that may arise both interior and exterior to the shell surface. Therefore, the perimeter zone must be stronger than the interior shell surface alone. In nature, this necessary strengthening of shell edges is seen in many examples, notably in the thickening of edges of tortoise, abalone, and walnut shells.

The form and shape of this disclosed dome perimeter is important because the height of the shell edge above ground level forms an opening which can be used for entry into the structure to provide for window space and to be used for flat, vertical wall surfaces.

There are structural advantages in having the shell perimeter formed and strengthened by underlying edge arches, extending along great circles. It is also convenient to have other interior arches for the purpose of shaping and strengthening the shell surface and these intermediate arches should also be on great circles of the dome.

The perimeter and intermediate arches intersect one another to form spherical triangles. These spherical triangular openings must then be covered with appropriate shell surfacing material.

The purpose of the covering is for structural strength where low angle bending is acceptable but where close folding is not. The following covering techniques are acceptable:

Equilateral Triangles

Figure 15:
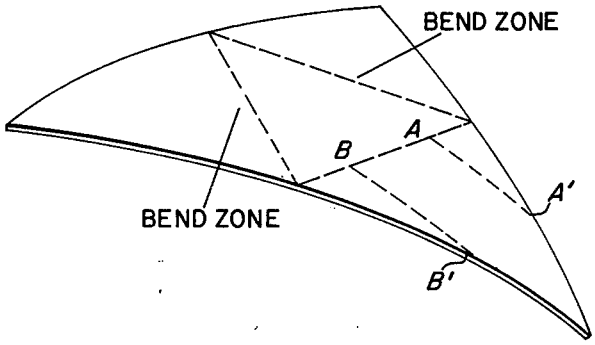
FIG. 15 is an illustration of an equilateral spherical triangle covered by a singly curved surface on which there are bend zones, with sections AA' and BB' showing elliptical intersections with the curved surface.

Any equilateral spherical triangle, having sides that are either great circles (or even small circles of the same radii) can be acceptably covered. The interior inscribed flat triangle is laid out to be a plane equilateral triangle. Reference is made to FIG. 15 wherein a curved equilateral triangle is shown on which there are bend zones. Sections AA' and BB' show elliptical intersections with the curved surface. The curved plane triangle is bent along these bend lines in three directions to cover the edges of the spherical triangle exactly.

It should be noted that the cross-sectional shapes of the three singly curved surfaces are the same and that they are all elliptical in form. These elliptical sections are the same for all sections at right angles to a bend zone. The bend zone is a tangential transition between the elliptical and flat surfaces, which is the requirement for an acceptable covering.

Isosceles Triangles

The spherical isosceles triangle being considered here must be formed of great circles or small circles with the same radii.

Figure 16A:
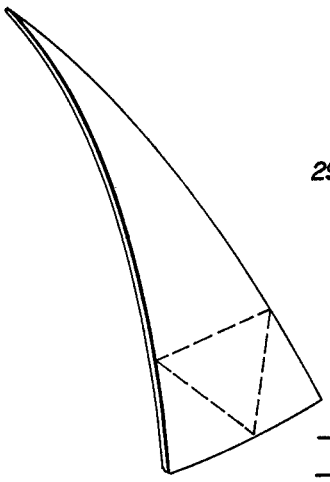
FIGS. 16A and 16B illustrate curved isosceles triangles with inscribed plane isosceles triangles.
Figure 16B:
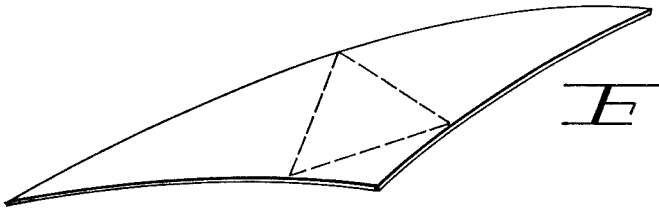
Figure 17:
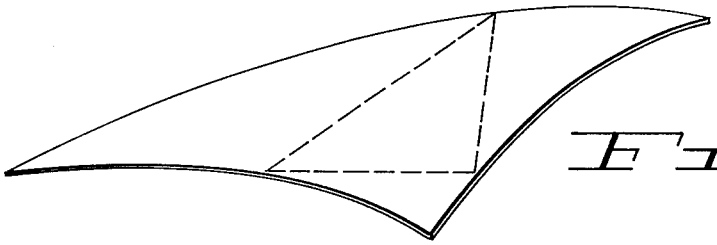
FIG. 17 illustrates a spherical scalene triangle with an inscribed plane triangle.

An inscribed plane isosceles triangle is constructed as shown in FIGS. 16A and 16B and the covering plane surface is bent and curved downwardly to cover the curved triangle edges exactly. This covering technique is also structurally acceptable because there is a tangential transition between the elliptical and flat surfaces, as was the situation with the curved equilateral triangle.

Scalene Triangles

A spherical scalene triangle having three unequal sides can be acceptably covered with an originally flat surface. However, the sections through the curved surface at right angles to a bend zone may not be identical elliptical curves.

Figure 21:
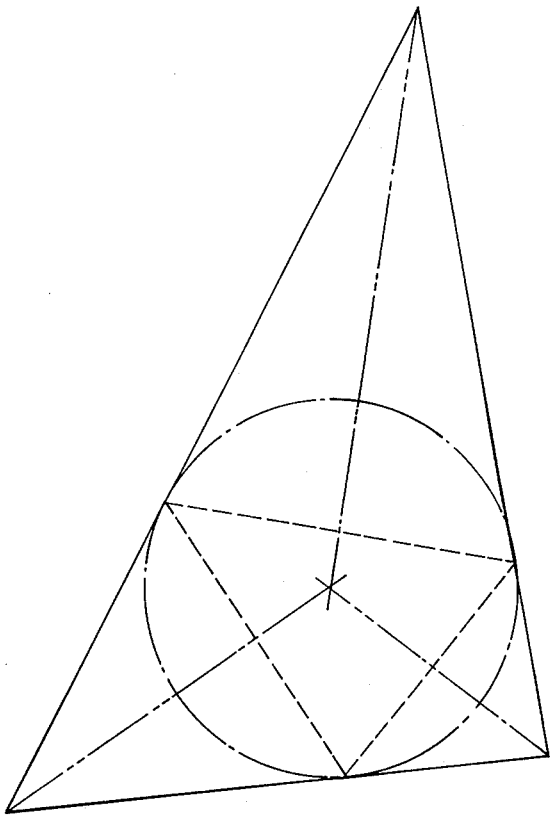
FIG. 21 illustrates a plane scalene triangle with an inscribed circle.
Figure 22:
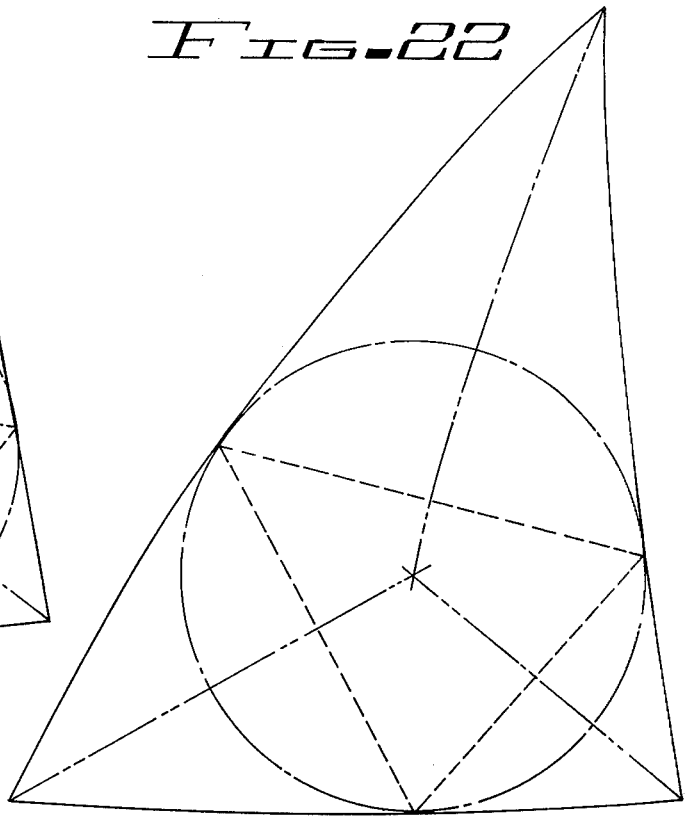
FIG. 22 illustrates a spherical scalene triangle with an inscribed small circle.

The method of covering a spherical scalene triangle is important because the technique generaly can be applied to any spherical triangular opening. A small circle must be inscribed in the scalene triangle. To properly locate the center of this circle, each of the corner angles of the scalene triangle must be bisected and the intersection of these bisectors will define the center of the circle to be inscribed. FIG. 21 illustrates the geometric construction techniques as applied to a flat planar triangle and FIG. 22 shows how to locate the center of an inscribed small circle on a spherical scalene triangle. Here it can be noted that the dihedral angle bisectors are also great circle arcs. The points of tangency of the inscribed circle with the three legs of the spherical triangle define the aspices of an inscribed scalene triangle, the edges of which are the straight bases for curved isosceles triangles lying in the corners of the spherical scelene triangle.

It should be noted that where two curved sides of the covered scalene triangle area of unequal length, the cross sections through a bend zone will not show identical elliptical curves but rather they are conical elliptical curves.

Figure 19:
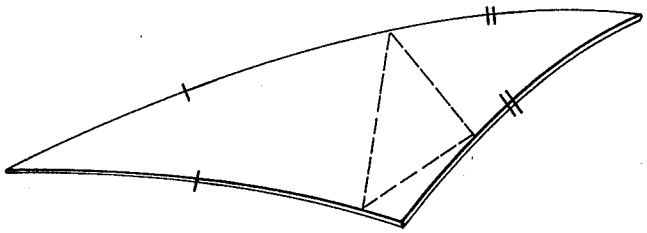
FIG. 19 illustrates a spherical scalene triangle with two equal-sided, singly curved triangles.

When covering a curved scalene triangle, it may be desirable to choose the position of the plane inscribed triangle so that the two curved sides adjacent to a bend zone are of equal length so that stress directions may be considered. On any scalene triangle, two such equal sided curved triangles may be selected, but the third will have two unequal sides as shown in FIG. 19. In order not to exceed the bending strength of the covering material, the lengths of the two unequal sides of the third curved triangle must be chosen with care because a conical, elliptical surface will be generated.

In order to have a structurally acceptable covering surface, the smallest radius of the conical elliptical surface must be larger than the minimum (strengthwise) radius of curvature of the covering material.

Figure 18:
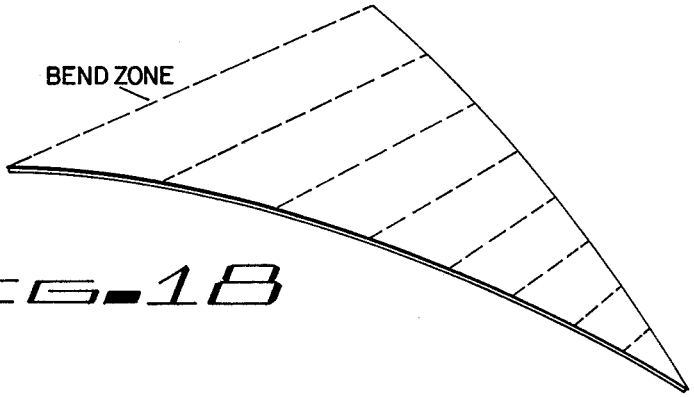
FIG. 18 illustrates a scalene, curved triangular opening covered with an originally flat surface.

The form of the conical surface can be calculated by approximating this surface with a number of nonparallel bend zones. Processing from the true bend zone at the base of the curved triangle, the bend zones converge to form an infinitesimally small isosceles triangle at the apex of the curved triangle, as shown in FIG. 18. This construction supports the rule tending that curved isosceles triangles must be used to cover spherical triangles. It should be noted that secondary nonparallel bend zones converge to an infintesimally small isosceles triangle.

Figure 20:
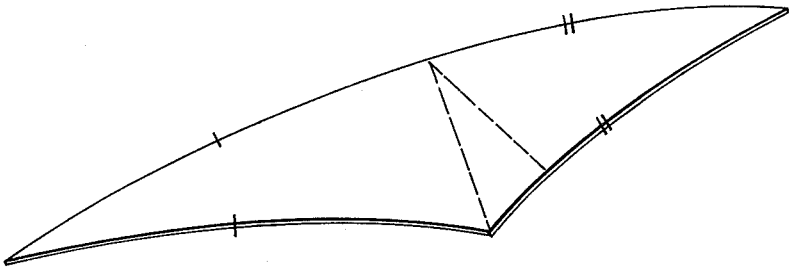
FIG. 20 illustrates a spherical scalene triangle having an inscribed interior triangle with a conical surface.

Another acceptable way of fitting a singly curved (originally flat) surface to a spherical scalene triangle is to allow the inscribed interior triangle to be a conical surface rather than a flat, straight sided triangular surface. This is illustrated in FIG. 20. The straight sided legs of the interior triangle are shown as dashed lines and the construction allows curved isosceles triangles to be formed in the remaining two areas, as is shown.

Application of Roofing to a Domical Framework

The roof is formed of spherical triangular panels covered with originally flat surface material.

In the domical surface shown in FIGS. 1–3, the primary, secondary and edge arches are arcs of great circles and they form the sides of spherical triangles to be covered. The roof panels are originally flat, and when appropriately curved and fastened to the arches, the panels act as a shell, giving overall strength to the structure. Cross members, or tertiary beams, can be located at the bend zones to lend additional strength and support. However, a bend zone in itself acts like a straight structural member. The strength of the surface shell can be varied with different materials.

Several geometric parameters can be varied to satisfy the conditions required for a strong roof structure. Generally, all roof panels are designed such that the bend zones are continuous between panels so as to form a tension ring. Some compromise is made for the sake of symmetry and geometric compatibility with adjacent panels.

Figure 6:
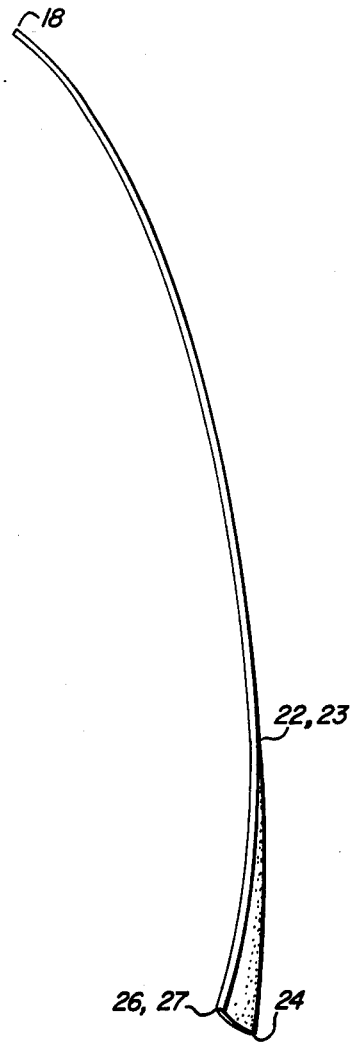
FIG. 6 is a side view of the roof panel shown in FIG. 4.
Figure 4:
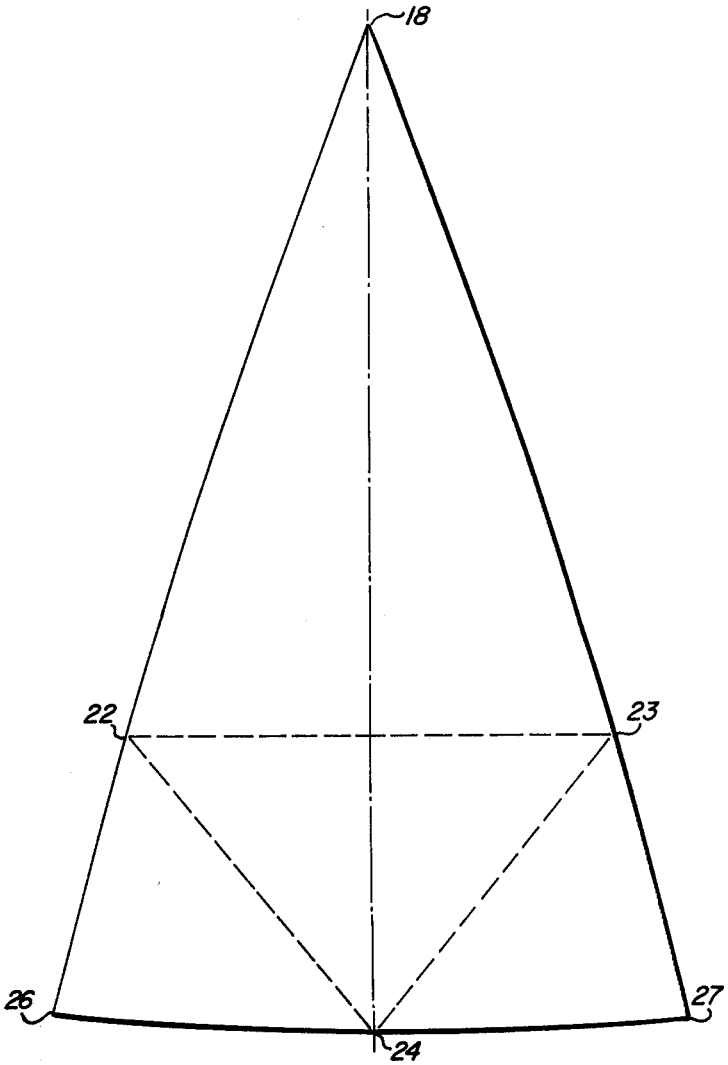
FIG. 4 is a top view of a center roof panel showing the curvatures of the originally flat panel.
Figure 5:
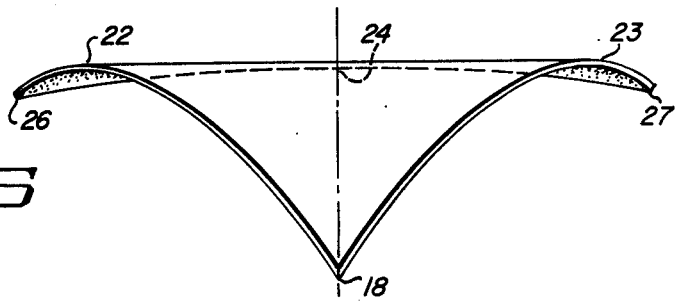
FIG. 5 is a front view of the roof panel shown in FIG. 4.

In providing a roof for the domical framework of the structure shown in FIGS. 1–3, an approximately isosceles spherical triangles shown in FIGS. 4–6 may be used having corners 18, 26 and 27. Ideally, there is an inscribed plane isosceles triangle within this figure, such as the triangle formed by points 22, 23, 24 of FIG. 4. The forming of triangle 22, 23, 24 within triangle 18, 26, 27 permits the layout of three plane curved isosceles triangles formed by points 23, 28, 22; 24, 26, 22; and 23, 27, 24. Triangle 18, 26, 27 of FIG. 4 is not made exactly a simple plane triangle so that edge 18, 22, 26 will adjoin a corresponding edge 18, 22, 26 in an adjacent spherical triangle 18, 29, 26 shown in FIGS. 1, 3 and 7–9. The entire spherical triangle 18, 26, 27 of FIGS. 1–3 can be covered with a single, originally flat surface with cross beams 17 underlying the bend zones as outlined by plane triangle 22, 23, 24, illustrated in FIGS. 4–6. Thus, the sides of the triangular panel 18, 26 and 27 are made to exactly overlay arches 15, 15, 15.

Figure 7:
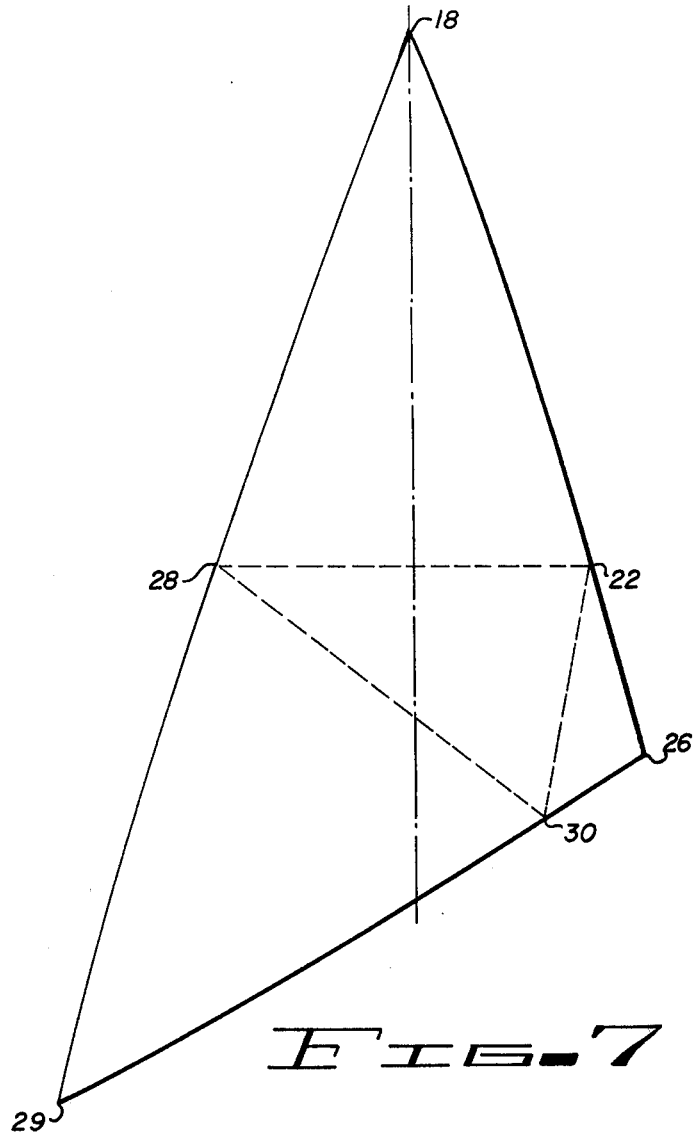
FIG. 7 is a top view of a corner roof panel showing the curvatures of the originally flat panel.
Figure 8:
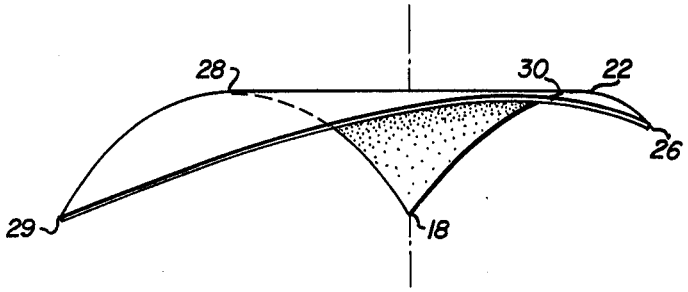
FIG. 8 is a front view of the corner roof panel shown in FIG. 7.

With reference to FIGS. 1 and 7, it is noted that spherical triangle 18, 26, 29 is approximately isosceles with side 18, 26 being about the same length as side 26, 29. It is possible to subdivide this larger spherical triangle into smaller curved plane triangles. It can be noted that point 28 is halfway between points 18 and 29 and that a distance between points 18 and 26 can be made to be the same as the distance between points 18 and 28. Also, the angle defined by the sides 26, 18 and 29 18 can be made substantially the same as the angle between the lines defined by points 26, 18 and 27, 18 thereby providing overall symmetry to the domical structure.

Thus, it is possible to lay out the interior plane triangle 28, 30, 22 such that triangles 28, 18, 22 and 29, 28, 30 are figures with equal curved sides 28, 18; 22, 18; 28, 29 and 30, 29 with straight bases 28, 22 and 28, 30. The remaining small triangles 22, 26, 30 is not isosceles; however, the radius of curvature of the conical surface is not too small so that the extension of a single curved surface will adequately cover this opening. The bend zones of the originally flat roof panel are shown as dash lines on FIG. 7. The curved edges of the panel will exactly overlay beams 14, 15, 16 of FIGS. 1–3.

The remaining seven spherical triangles of the domical structure shown in FIGS. 1, 2 and 3 can be laid out in duplication of the two triangles just described. This permits the entire roof of the domical structure to be covered with nine originally flat panels. Joints in the flat roofing panel material should be made over straight struts, such as at bend zones, so that there is no loss in shell strength.

Although the domical strength is shown herein with a roof configuration only, suitable walls, doors and windows may be arranged any place under the roof structure as known in the prior art.

Figure 23:
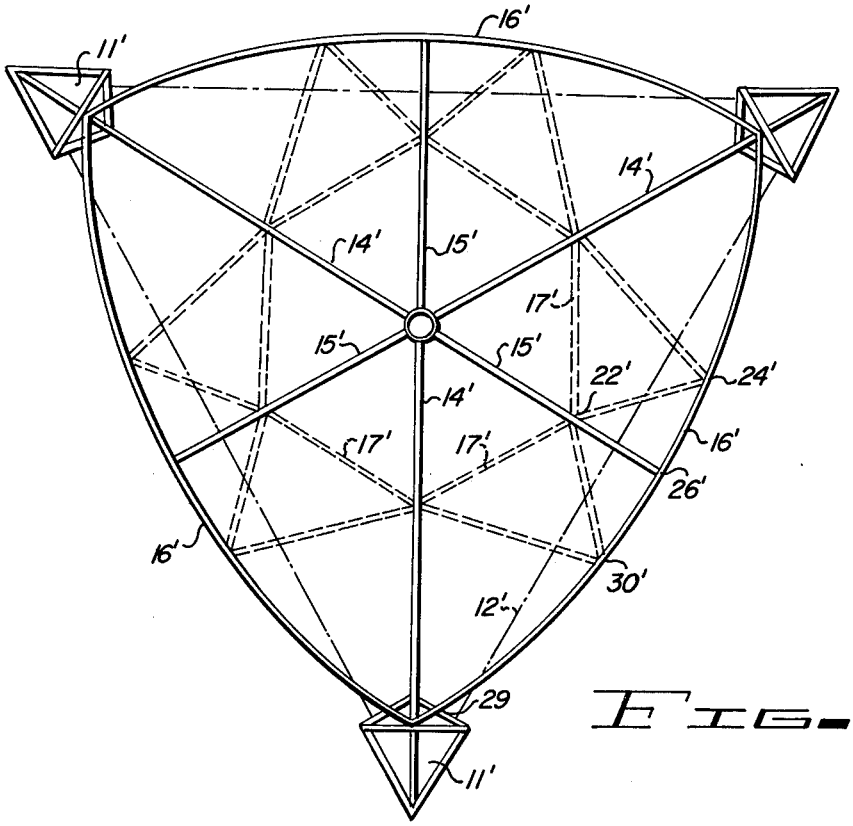
FIG. 23 is a top view similar to FIG. 1 using three secondary arches in place of six secondary as shown in FIG. 1.

FIG. 23 is a top view of a domical structure similar to that shown in FIGS. 1–3 wherein like parts are provided with the prime of reference characters used for the various parts of similar structural elements shown in FIGS. 1–3. FIG. 23 differs from FIGS. 1–3 in that only three secondary arches 15' are used in place of the six secondary arches 15 shown in FIGS. 1–3.

The method of covering spherical scalene triangles can be readily applied to the domical structure shown in FIG. 23. As described above with reference to FIGS. 21 and 22 a small circle may be inscribed in the spherical scalene triangles formed by the primary and secondary arches 14' and 15' and the edge arch 16'. The corner angles of the scalene triangles are bisected and the intersection of these bisectors define the center of the circle to be inscribed. The points of tangency of the inscribed circle with the three sides of the spherical triangle formed by the primary and secondary arches 14' and 15' and the edge arch 16' define the apices of an inscribed scalene triangle, the edges of which are the straight bases (bend lines) for curved isosceles triangles lying in the corners of the spherical scalene triangle.

What is claimed is:

1. A domical structure comprising:

a plurality of bases, a first plurality of arcuately shaped beams each carried on at least one end by a different one of said bases and extending therefrom in a substantially vertical plane, a first means for connecting said first beams at the apex of said structure, a plurality of arcuately shaped edge beams supported on adjacent bases and extending upwardly and outwardly therebetween to define the perimeter of said structure, a second plurality of arcuately shaped beams carried on at least one end by one of said edge beams and at their other ends by said first means at the apex of said structure, said second plurality of arcuately shaped beams being spaced around the domical structure between each of said first plurality of arcuately shaped beams, said first and second plurality of beams and said plurality of edge beams being arcs of great circles and forming a structural framework defining spherical triangular openings, said spherical triangular openings each having a corner of said triangles at the apex of said domical structure, and a domically shaped covering for the structure comprising a plurality of originally flat panels each of a curved triangular configuration the edges of which lie on the arcuate beams of said framework in edge to edge assembly around said structure and each panel covering one of said curved triangular openings formed together a dome-like outer configuration, each of said panels being formed by three curved substantially isosceles triangles formed in the corners of each spherical triangular opening together with an interconnecting plane triangle.

2. The domical structure set forth in claim 1 wherein:

said spherical triangular openings are of two different triangular configurations.

3. A domical structure having an apex and supportable on three spaced bases comprising:

a first plurality of arcuately shaped beams each carried on one end by a different one of the bases, a first means for connecting said first beams at the apex of said structure, a plurality of arcuately shaped edge beams extending upward and outward forming the perimeter of said structure, a second plurality of arcutely shaped beams each carried on at least one end by one of said edge beams and secured at their other ends by said first means at the apex of said structure, said second plurality of arcuately shaped beams being spaced around the domical structure between each of said first plurality of arcuately shaped beams, said first and second plurality of beams and said plurality of edge beams forming a structural framework defining curved triangular openings, a domically shaped roof covering for said domical structure, said roof covering comprising a plurality of singly curved triangular panels, each of said panels having a common corner thereof at the apex of the structure and a common edge between adjacent panels, the edges of each panel lying on an arcuate beam of said framework so that the panels cover the entire area formed by the framework, and means for connecting juxtapositioned edges of said panels together to form said domically shaped roof covering.

4. The roof set forth in claim 3 wherein:

the juxtapositioned edges of said singly curved triangle surfaces are connected together to form a domical configuration each substantially covering a different one of said curved triangular openings.

5. The domical structure set forth in claim 3 in further combination with:

a plurality of bases one for supporting each of said first plurality of arcuately shaped beams.

6. The domical structure set forth in claim 3 in further combintion with:

three bases, and wherein said first plurality of arcuately shaped beams comprise three in number each supported by one of said bases.

7. A domical structure comprising:

a plurality of arcuate edge beams extending upward and outward forming the perimeter of said structure, said plurality of edge beams forming a structural framework for said domical structure, a domically shaped roof covering for said framework, said roof covering comprising a plurality of spherical triangular sectors with each sector comprising a plane surface panel formed by inscribing a circle touching at tangent points the three sides of a spherical triangular sector and bending said panel from said tangent points to define three singly curved parts for each of said triangular sectors, said edge beams defining the outer perimeter edge of said roof covering and forming an edge of a plurality of said spherical triangular sectors, said tangent points defining the ends of the straight bases of three singly curved triangular panels, and a flat plane triangular panel interior to said triangular panels bordering on the three bases of said curved triangular panels, said curved triangular panels each fitting into a different apex of one of the spherical triangular sectors with the flat plane triangular panel bordering the bases of said three curved triangular panels, and means for connecting the panels of said roof covering into a unitary structure.

8. A domical structure comprising:

a first plurality of spaced arches in vertical planes interconnected in a domical structural framework by a plurality of arched edge beams forming the perimeter of said domical structure, said framework defining a plurality of spherical triangular sectors, a domically shaped roof covering for said framework, said roof covering comprising a plane surface panel for each spherical triangular sector formed by inscribing a circle touching at tangent points the three sides of a spherical triangular sector and bending said panel from said tangent points to define three singly curved parts for each of said triangular sectors, said tangent points defining the ends of the straight bases of three singly curved triangular panels, and a flat plane triangular panel interior to said triangular panels bordering on the three bases of said curved triangular panels, said curved triangular panels each fitting into a different apex of one of the sperical triangular sectors with the flat plane triangular panel bordering said straight bases, and means for connecting the panels of said roof covering into a unitary structure.

9. A domical structure comprising:

a first plurality of spaced arcuate beams forming arcs of great circles, a first means for connecting said first beams at the apex of said structure, a plurality of arcuate edge beams extending upward and outward forming the perimeter of said structure, a second plurality of arcute beams each carried on at least one end by one of said edge beams and secured at their other ends by said first means at the apex of said structure, said second plurality of arcuate beams being spaced around the domical structure between each of said first plurality of arcuate beams, said first and second plurality of beams and said plurality of edge beams forming a structural framework defining spherical triangular sectors, a domically shaped roof covering for said framework, said roof covering comprising a plane surface panel for each spherical triangular sector formed by inscribing a circle touching at tangent ponts the three sides of a spherical triangular sector and bending said panel from said tangent points to define three singly curved parts for each of said triangular sectors, said tangent points defining the ends of the straight bases of three singly curved isosceles triangular panels, and a flat plane triangular panel interior to said isosceles triangular panels bordering on the three bases of said curved isosceles triangular panels, said curved isosceles triangular panels each fitting into a different apex of one of the spherical triangular sectors with the flat plane triangular panel bordering the bases of said three curved isosceles triangular panels, and means for connecting the panels of said roof covering into a unitary structure.

* * * * *

UNITED STATES PATENT OFFICE

CERTIFICATE OF CORRECTION

Patent No. 4,068,422 Dated January 17, 1978

Inventor(s) John S. Sumner

It is certified that error appears in the above-identified patent and that said Letters Patent are hereby corrected as shown below:

Column 10, line 23, "formed" should read -- forming --.

Column 12, line 20, "arcute" should read -- arcuate --.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*